US009510397B2

(12) United States Patent
Tanaka et al.

(10) Patent No.: US 9,510,397 B2
(45) Date of Patent: Nov. 29, 2016

(54) HIGH-FREQUENCY INDUCTION HEATING APPARATUS AND FILM LABEL ATTACHING APPARATUS

(75) Inventors: Hiroki Tanaka, Kanagawa (JP); Kouji Wakisaka, Kanagawa (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 275 days.

(21) Appl. No.: 14/342,194

(22) PCT Filed: Aug. 15, 2012

(86) PCT No.: PCT/JP2012/005159
§ 371 (c)(1),
(2), (4) Date: Apr. 4, 2014

(87) PCT Pub. No.: WO2013/031116
PCT Pub. Date: Mar. 7, 2013

(65) Prior Publication Data

US 2014/0202638 A1 Jul. 24, 2014

(30) Foreign Application Priority Data

Sep. 1, 2011 (JP) ..... 2011-190257

(51) Int. Cl.
*B65C 9/00* (2006.01)
*H05B 6/10* (2006.01)
(Continued)

(52) U.S. Cl.
CPC ..... *H05B 6/102* (2013.01); *B65C 9/00* (2013.01); *H05B 6/06* (2013.01); *H05B 6/105* (2013.01); *H05B 6/44* (2013.01)

(58) Field of Classification Search
CPC ..... B65C 9/00; H05B 6/06; H05B 6/105; H05B 6/44; H05B 6/102
See application file for complete search history.

(56) References Cited

U.S. PATENT DOCUMENTS 3,057,985 A * 10/1962 Biringer ..... H05B 6/06 219/662
4,443,679 A * 4/1984 Balordi ..... H05B 6/105 219/618
4,539,456 A * 9/1985 Mohr ..... B21D 51/26 156/274.2

(Continued)

FOREIGN PATENT DOCUMENTS

JP 54-157353 A 12/1979
JP 61123522 A * 6/1986

(Continued)

OTHER PUBLICATIONS

International Search Report for corresponding International Application No. PCT/JP2012/005159, mailed Sep. 11, 2012 (4 pages).

(Continued)

*Primary Examiner* — Daniel McNally
(74) *Attorney, Agent, or Firm* — Osha Liang LLP

(57) ABSTRACT

A high-frequency induction heating apparatus is provided with a high-frequency oscillation apparatus, a heating coil, a high-frequency transformer and the like, the heating coil has a first coil through which prescribed current outputted by the high-frequency oscillation apparatus is flown, a second coil through which current different from the predetermined current is flown by the high-frequency transformer, and the first coil heats a trunk part and a bottom side part of the can body, and the second coil heats the trim side part of the can body.

2 Claims, 8 Drawing Sheets

(51) Int. Cl.
*H05B 6/06* (2006.01)
*H05B 6/44* (2006.01)

(56) References Cited

U.S. PATENT DOCUMENTS

| | | | | |
|---|---|---|---|---|
| 4,950,348 | A * | 8/1990 | Larsen | F16B 11/006 156/274.8 |
| 2004/0104512 | A1 * | 6/2004 | Eidenschink | A61M 25/0009 264/295 |
| 2010/0258556 | A1 | 10/2010 | Hayashi et al. | |

FOREIGN PATENT DOCUMENTS

| | | | |
|---|---|---|---|
| JP | 10-683 | A | 1/1998 |
| JP | 10000683 | A * | 1/1998 |
| JP | 10-31379 | A | 2/1998 |
| JP | 10-189234 | A | 7/1998 |
| JP | 2001-179830 | A | 7/2001 |
| JP | 2002-180130 | A | 6/2002 |
| JP | 2009-158366 | A | 7/2009 |
| JP | 2011-49178 | A | 3/2011 |

OTHER PUBLICATIONS

Written Opinion for corresponding International Application No. PCT/JP2012/005159, mailed Sep. 11, 2012 (5 pages).

International Preliminary Report on Patentability for corresponding International Application No. PCT/JP2012/005159, mailed Mar. 13, 2014 (7 pages).

* cited by examiner

HIGH-FREQUENCY INDUCTION HEATING APPARATUS AND FILM LABEL ATTACHING APPARATUS

TECHNICAL FIELD

The present invention relates to a high-frequency induction heating apparatus and a film label-attaching apparatus. In particular, the present invention relates to a high-frequency induction heating apparatus that can heat a can body uniformly, as well as to a film label-attaching apparatus.

BACKGROUND ART

Conventionally, due to the features such as the possibility of high-speed heating and easiness in temperature control, a high-frequency induction heating apparatus has been used to heat various objects to be heated.

In the field of production of a can body, a technology in which a thermoplastic synthetic resin film (e.g. a polyester film or the like) (hereinafter, appropriately abbreviated as a film label) which has been subjected to gravure printing or the like in advance is attached to a molded can trunk to produce a 2-piece can body has been put into practical use. This technology has a can body heating process in which a can body is heated by a high-frequency induction heating apparatus.

For example, Patent Document 1 discloses a technology of an apparatus for producing a film label-attached 2-piece can body (also called a film label-attaching apparatus) characterized in that, in an apparatus for producing a film label-attached 2-piece can body in which a 2-piece can body of which the trunk has been molded is fitted to a mandrel, and a film label is attached to the outer circumference of the trunk during the conveyance of the can body, the apparatus is provided with a heating means that heats a can body to a predetermined temperature along the revolution path of the mandrel and a cooling means that cools the film label-attached can body subsequent to an attachment roll. In this technology, a high-frequency inducting heating coil is used as the heating means of a can body.

Patent Document 2 discloses a technology of a film-attaching apparatus (also called as a "film label-attaching apparatus") in which a decorative film is attached to a can body similar to that in Patent Document 1.

This technology is characterized in that, in addition to the can body-heating means, a mandrel-heating means that inductively heats an outer sheath element of a mandrel is provided. In both of these means, a high-frequency induction heating coil is used. FIG. 5 of Patent Document 2 shows a schematic oblique view of the shape of the high-frequency induction heating coil.

Further, various technologies regarding a high-frequency inducting heating apparatus have been proposed.

For example, Patent Document 3 discloses a technology of a high-frequency heating apparatus that inductively heats parts to be heated of a metal body, which comprises a plurality of heating coils helically formed and arranged and fixed with a predetermined interval being provided with each other and a conveyance means that conveys the metal body such that the parts to be heated are passed sequentially above each heating coil, wherein the parts to be heated are sequentially subjected to high frequency heating by an induction magnetic field of each heating coil. The heating coils are connected in series or in parallel.

Further, Patent Document 4 discloses a technology of an induction heating apparatus in which a plurality of heating coils are connected in parallel to one high-frequency power source, and AC reactors are respectively connected in series in correspondence with each heating coil.

Patent Document 5 discloses a technology of an electromagnetic heating apparatus provided with a resonant circuit having an induction heating coil for heating an object to be heated and a switching circuit for supplying high-frequency current to the resonant circuit, in which the induction heating coil is provided with a plurality of first coils connected with each other in parallel and second coils that are respectively connected to the first coil in series, the coils are arranged approximately concentrically on an approximate same plane, the resonant circuit is divided into the number of the pair of the first coil and the second coil, and, according to the resonant circuit, an independent switching circuit is connected.

Conventional Examples

Next, an explanation is made on a conventional high-frequency induction heating apparatus with reference to the drawings.

FIG. 7 is a schematic cross-sectional view of essential parts for explaining a conventional high-frequency induction heating apparatus.

As shown in FIG. 7, a conventional high-frequency induction heating apparatus 101 is provided with a multiply-wound heating coil 103 (seven turns, in this example), a ferrite-made case 133 that accommodates the heating coil 103, a high-frequency oscillation apparatus (not shown) for flowing AC current to the heating coil and the like. This heating apparatus 101 is provided in a film label-attaching apparatus (not shown). In this high-frequency induction heating apparatus 101, prescribed current outputted by the high-frequency oscillation apparatus flows the heating coil 103, and a can body 10 (a conventional steel can, in this example) being conveyed by a mandrel 105 is inductively heated.

The film label-attaching apparatus has a plurality of rotatable mandrels 105, and is provided with a conveyance means that conveys the can body 10 which has been fitted to the mandrel 105, a high-frequency induction heating apparatus 101 that inductively heats the can body 10 which has been fitted to the mandrel 105, an attaching means that attaches a film label to the can body 10 being conveyed in the downstream side of this high-frequency induction heating apparatus 101 and the like. The conveyance means, the attaching means and the like have almost similar configurations as those in the film label-attaching apparatus in the above-mentioned Patent Document 1.

(Can Body)

The can body 10 is made of steel, and is a 2-piece can having a trunk part 11, a trim side part 12 and a bottom side part 13. In the can body 10, the plate thickness of each of the trim side part 12 and the bottom side part 13 is larger than that of the trunk part 11. Therefore, in order to heat the can body 10 such that the outer surface thereof has a uniform temperature distribution, heating conditions suited to heating the trim side part 12, the bottom side part 13 and the trunk part 11 are appropriately set.

(Mandrel)

The mandrel 105 is rotatably attached to a rotating body of the conveyance means of the film label-attaching apparatus, and has a ferrite plate 151 and the like. Further, the mandrel 105 has an air circulation hole in order to make sure that the can body 10 is mounted and discharged (at the time of discharge) without fail.

Further, the ferrite plate 151 having a ferrite-made cylindrical part and a ferrite-made flange part is provided in adjacent to the mounting part of the can body 10, and the flange part is formed such that it is close to the bottom part of the side plate of the case 133. As a result, the magnetic flux of the trim side part 12 of the can body 10 is adjusted, whereby heating is conducted efficiently.

The can body 10 that has been fitted to the mandrel 105 revolves while rotating by the rotation of the mandrel 105 and the rotation of the rotating body, and in this state, the can body passes through the inside of the case 133.

(Case)

The case 133 is normally made of ferrite and has an upper plate and a pair of side plates. Further, the case 133 has a shape that is bent along the direction of the conveyance of the can body 10. This case 133 has a function of preventing leakage of the magnetic field outside or adjusting the magnetic flux. Therefore, the structure of the case 133 or the ferrite plate 151 is set almost to a structure shown in FIG. 7, although it is varied appropriately.

(Heating Coil)

The heating coil 103 normally includes a copper-made tube as a wiring. Inside the tube, a coolant (normally, cooling water) is circulated. In this example, the coil has 7 turns.

Further, in the heating coil 103, the distance between the can body 10 and the coil and the pitch of the coils and the like are appropriately set such that the outer surface temperature in the axial direction of the can body 10 to be fitted to the mandrel 105 has a uniform temperature distribution.

In the above-mentioned high-frequency induction heating apparatus 101, the distance between the heating coil 103 and the can body 10 and the pitch of the coils and the like are appropriately set, whereby the can body 10 can be inductively heated at a high speed (within a short time) such that the outer surface has a uniform temperature distribution.

RELATED ART DOCUMENTS

Patent Documents

Patent Document 1: JP-A-2001-179830
Patent Document 2: JP-A-H10-000683
Patent Document 3: JP-A-2002-180130
Patent Document 4: JP-A-H10-189234
Patent Document 5: JP-A-2009-158366

SUMMARY OF THE INVENTION

Subject to be Solved by the Invention

In the can body, a decrease in plate thickness has been strongly desired. However, since the trim side part cannot be thin easily due to the need of processing (necking, flange molding, seaming and the like) in the later stages, if an attempt is made to decrease the plate thickness, normally, the can body has a structure having a large or rapidly changing plate thickness distribution.

For example, as shown in FIG. 8, a conventional steel can (having a large plate thickness) has a plate thickness ratio of the plate thickness of the trim side part (=Tf) and the plate thickness of the central part of the trunk part (=Tw) (=Tf/Tw) of about 1.14.

On the other hand, a thin-walled steel can has a plate thickness of the central part of the trunk part (=Tw) is decreased by nearly half. However, the plate thickness of the trim side part remains relatively large, and the plate thickness ratio (=Tf/Tw) is about 1.83.

When a conventional steel can is heated by a high-frequency induction heating apparatus 101, the temperature unevenness (=ΔT) is about 35° C. (temperature unevenness that is almost tolerable). In contrast, when a thin-walled steel can is heated by the high frequency induction heating apparatus 101, even if the distance between the heating coil 103 and the can body (a thin-walled steel can), the pitch and the like are adjusted, the temperature unevenness (=ΔT) is about 50° C., which is intolerable. It is impossible or almost practically impossible to adjust them so that the temperature unevenness (=ΔT) becomes 30° C. or less (see Comparative Example 1, mentioned later).

Even when an aluminum-made can body is used as an object to be heated, since aluminum greatly differs from steel in induction heating efficiency and thermal conductance, as in the case of a thin-walled steel can, the temperature unevenness (=ΔT) is as large as about 60° C., and adjustment is difficult (see Comparative Example 2, given later).

That is, in the above-mentioned high-frequency induction heating apparatus 101, if a plurality of heating coils 103 are arranged altogether in such a manner that they get close to the trim side part in order to heat the trim side part having a large plate thickness, while the trim side part is sufficiently heated, a trunk part having a small plate thickness that is close to the trim side part is overheated, and hence, heating cannot be conducted such that the outer surface of the can body has a uniform temperature distribution in the axial line direction of the can body.

In a film label-attaching apparatus, if heating is not conducted such that the outer surface temperature of the can body in the axial line direction has a uniform temperature distribution, adhesion strength of a film label varies, and as a result, problems arise that peeling of a film label occurs in the post treatment or wrinkles are formed at the time of neck-in processing.

Although the technologies disclosed in Patent Documents 3 to 5 relate to the present invention, they could not be able to solve the above-mentioned problem.

The present invention has been made in order to solve the above-mentioned problems, and is aimed at providing a high-frequency induction heating apparatus capable of heating uniformly an object to be heated even if the plate thickness distribution of the object to be heated is large or varies suddenly.

Means for Solving the Problems

In order to attain the above object, the high-frequency induction heating apparatus of the present invention comprises a high-frequency oscillation apparatus and a heating coil through which current from the high-frequency oscillation apparatus is flown, wherein the heating coil has a first coil though which predetermined current outputted by the high-frequency oscillation apparatus is flown, and a second coil through which current different from the predetermined current is flown by a high-frequency current transformer and/or a third coil through which current different from the predetermined current is flown by a parallel circuit;

the first coil heats a first part of an object to be heated, and the second coil heats a second part of the object to be heated and/or the third coil heats a third part of the object to be heated.

The film label-attaching apparatus of the present invention that has a plurality of rotatable mandrels and is provided with a conveyance means that conveys a can body fitted to the mandrel and a heating means that inductively heats the can body fitted to the mandrel and an attaching means that attaches a film label to the can body being conveyed in the downstream side of the heating means, wherein the heating means is the high-frequency induction heating apparatus mentioned above.

Further, the high-frequency induction heating apparatus of the present invention comprises a high-frequency oscillation apparatus, a plurality of high-frequency transformers which are connected in series to the high-frequency oscillation apparatus, and a heating coil through which current from the plurality of high-frequency transformers is flown, and the heating coil respectively heats parts of an object to be heated.

Advantageous Effects of the Invention

According to the high-frequency induction apparatus and the film label-attaching apparatus of the present invention, even if the plate thickness distribution of an object to be heated (a, thin-walled can body, for example) is large or varies suddenly, the object to be heated can be uniformly heated.

MODE FOR CARRYING OUT THE INVENTION

[First Embodiment of the High-Frequency Induction Heating Apparatus]

Hereinbelow, an explanation will be made on the first embodiment of the high-frequency induction heating apparatus of the present invention in accordance with an example in which it is used as a can body heating means of a film label-attaching apparatus.

Figure 1:
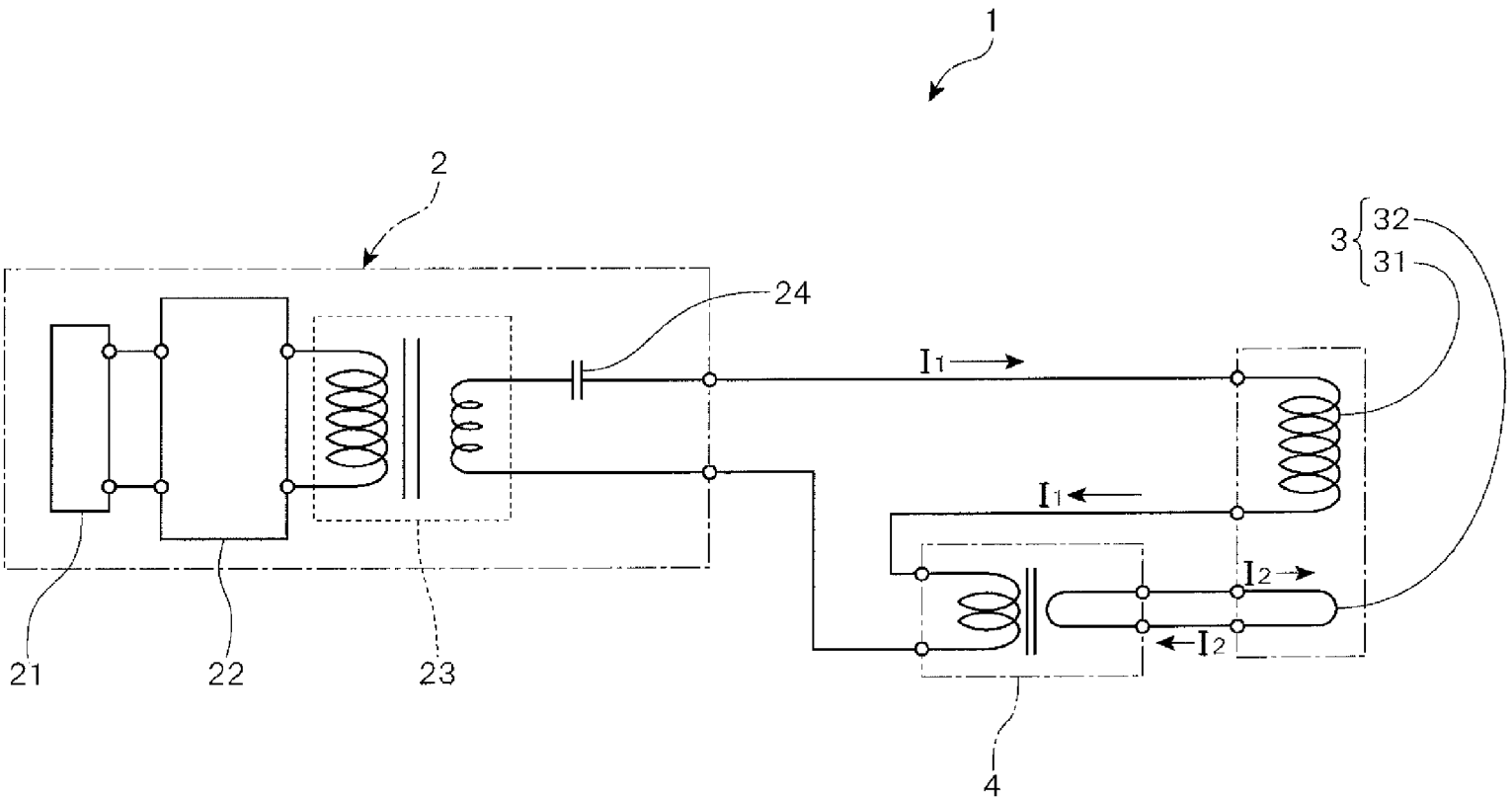
FIG. 1 is a schematic view of essential parts for explaining a high-frequency induction heating apparatus according to a first embodiment of the present invention.

FIG. 1 is a schematic view of essential parts for explaining a high-frequency induction heating apparatus according to a first embodiment of the present invention.

Figure 2A:
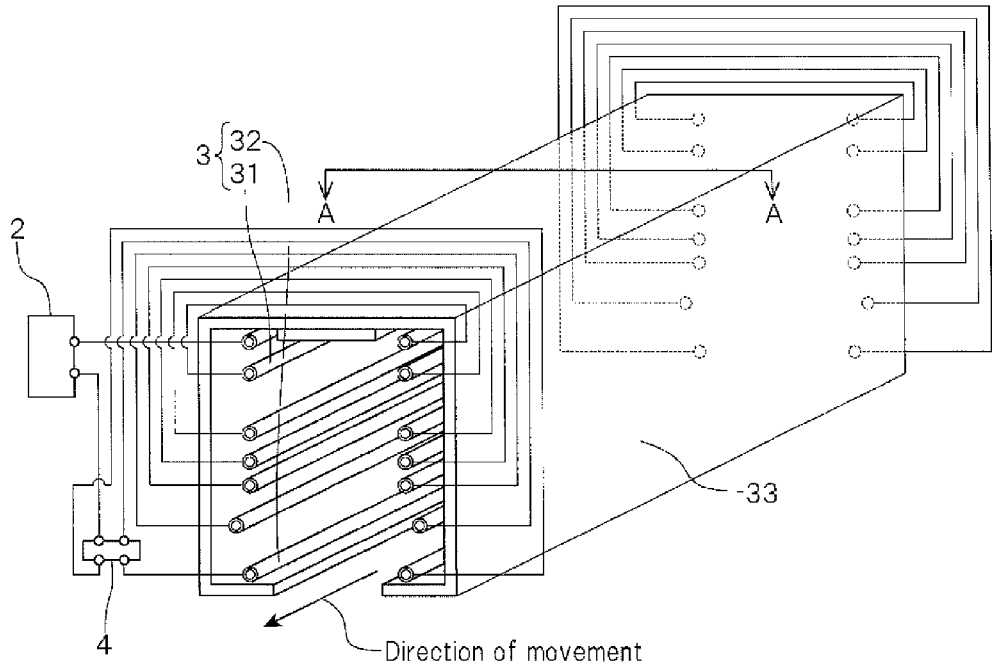
FIG. 2*a* is a schematic oblique view of essential parts for explaining the high-frequency induction apparatus according to the first embodiment of the present invention.

FIG. 2*a* is a schematic oblique view of essential parts for explaining the high-frequency induction apparatus according to the first embodiment of the present invention.

Figure 2B:
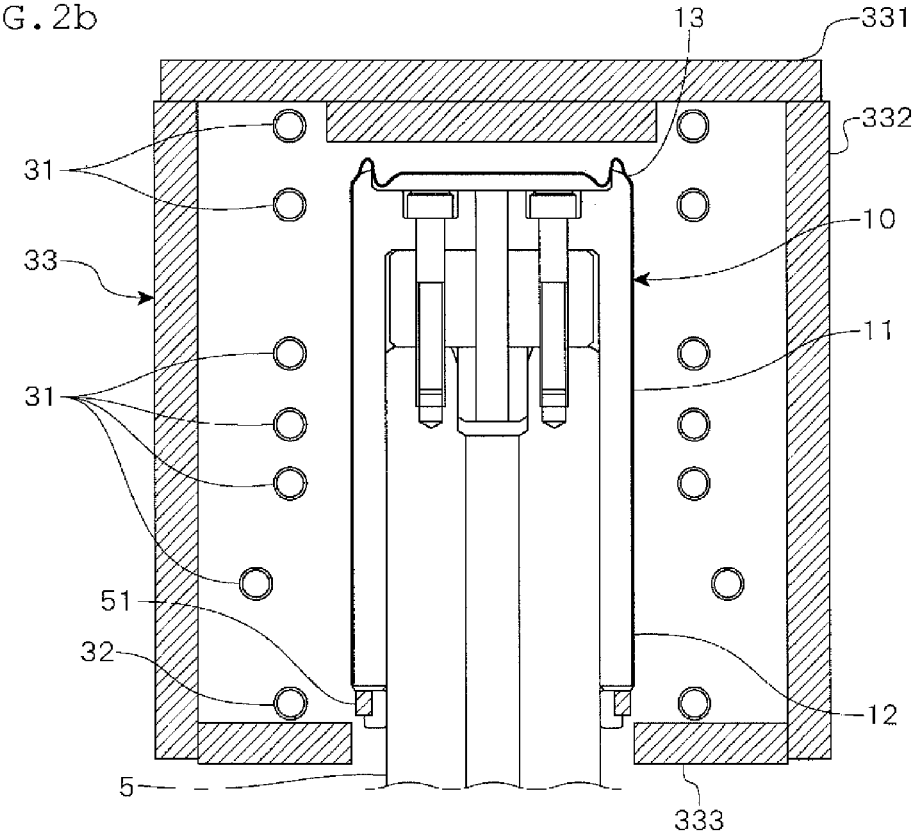
FIG. 2*b* is a schematic cross-sectional view taken along the line A-A of essential parts for explaining the high-frequency induction apparatus according to the first embodiment of the present invention.

FIG. 2*b* is a schematic cross-sectional view taken along the line A-A of essential parts for explaining the high-frequency induction apparatus according to the first embodiment of the present invention.

In FIGS. 1, 2*a* and 2*b*, the high-frequency induction heating apparatus 1 of this embodiment has a configuration in which a high-frequency current transformer 2, a heating coil 3 through which current from the high frequency oscillator 2 is flown, a high-frequency transformer 4 and the like are provided. This high-frequency induction heating apparatus) is provided in a film label-attaching apparatus (not shown), and heats, as an object to be heated, a can body 10 carried by a mandrel 5.

The film label-attaching apparatus in which the high-frequency induction heating apparatus 1 is provided has almost the same configuration as the film label-attaching apparatus in Patent Document 1, mentioned above.

(Can Body)

The can body 10 is made of a metal. For example, the can body is a thin-walled aluminum or steel can, for example. The can body is a two-piece can having a trunk part 11, a trim side part 12 and a bottom side part 13. Further, in the can body 10, the thicknesses of the trim side part 12 and the bottom side part 13 are larger than the thickness of the trunk part 11. As an example, this can body 10 has a plate thickness distribution shown in FIG. 8. In addition, the can body 10 as an object to be heated moves (revolves) while being rotated by the mandrel 5.

Although not particularly restricted, the can body 10 is rotated at a speed of several hundreds rpm, for example. For a heating time of about 1 second, it is heated from the normal temperature to about 160° C.

(High-Frequency Oscillation Apparatus)

The high-frequency oscillation apparatus 2 is provided with a power source part 21, an oscillation part 22, a matching transformer 23, a resonant capacitor 24 and the like, and outputs predetermined alternating current to ($I_1$) from an output terminal. The output terminal of the high-frequency oscillator 2 is connected in series to the first coil 31 of the heating coil 3 and a primary terminal of the high-frequency transformer 4.

It suffices that the high frequency be a frequency with which induction heating can be conducted, and normally, it is several kHz or more.

(Heating Coil)

The heating coil 3 has a first coil 31, a second coil 32 and the like.

The wiring of the first coil 31 and the second coil 32 normally includes copper-made tube-like wires or the like. Inside the tube-like wires, a coolant (normally, cooling water) is circulated. In the first coil 31 and the second coil 32, the main parts of the wires extend along the moving direction of the can body 10 in the left and right sides of the can body 10 that passes, and are wound such that they stride over the moving path at the inlet side and the outlet side. Further, each of the wires that have been wound in a plurality of stages is arranged to have a prescribed interval (pitch) in the axial direction of the can body 10.

Since the first coil 31 and the second coil 32 integrally constitute the heating coil 3, when only the arrangement of the wires is observed in the cross section of the moving direction of the can body 10 (FIG. 2*b*), no great difference can be observed between these coils and the conventional heating coil 103 (FIG. 7) formed of a single coil (FIG. 7), and hence the heating coil 3 can be applied easily to the existing film label-attaching apparatus.

As for the heating coil 3 (the first coil 31 and the second coil 32), the number of turns, the distance between the wires and the can body 10, the pitch of the wires and the like are set appropriately such that the outer surface temperature in the axial direction of the can body 10 to be fitted to the mandrel 5 has a uniform temperature distribution.

In this embodiment, the first coil 31 has 6 turns (see FIG. 2*a*). Further, the first coil 31 is connected in series between the output terminal of the high-frequency oscillation apparatus 2 and the primary terminal of the high-frequency transformer 4. Through the first coil 31, prescribed alternating current ($I_1$) outputted by the high-frequency oscillation apparatus 2 is flown, whereby the first part of the object to be heated (in this embodiment, the bottom side part 13 and the trunk part 11 of the can body 10) is mainly inductively heated.

In this embodiment, the second coil 32 has a single turn (see FIG. 2*a*). Further, the second coil 32 is connected to the secondary terminal of the high-frequency transformer 4. The second coil 32 is arranged such that, through this second coil 32, according to the ratio of current transformation of the high-frequency transformer 4, an alternating current ($I_2$) that is different from prescribed current ($I_1$) outputted by the high-frequency oscillation apparatus 2 is flown, whereby mainly the second part of the object to be heated (in this embodiment, the trim side part 12 of the can body 10) is inductively heated in a centralized manner.

In this way, the second coil 32 of which the heating power has been enhanced can heat the trim side part 12 sufficiently without overheating the trunk part 11 with a small plate thickness which is close to the trim side part 12. As a result, heating can be conducted such that the outer surface of the can body 10 in the axial direction has a uniform temperature distribution.

The current that is different from the prescribed current means current that is larger or smaller than the prescribed current. For example, if current that is larger than the prescribed current is flown, the heating performance of the second coil 32 is increased, and if current smaller than the prescribed current is flown, heating performance of the second coil 32 is lowered.

(High-Frequency Transformer)

The high-frequency transformer 4 has a matching transformer, a primary terminal, a secondary terminal and the like. The primary terminal is connected in series between the first coil 31 and the output terminal of the high-frequency oscillation apparatus 2, and the secondary terminal is connected to the secondary coil 32. In this high-frequency transformer 4, the ratio of current transformation K ($=I_2/I_1$) is about 2.5. The ratio of current transformation K is not limited to about 2.5, and is appropriately set according to an object to be heated (for example, the ratio of current transformation may be $K<1$ for a certain object to be heated).

(Case)

The case 33 is normally made of ferrite. In this embodiment, it has a top plate 331, a pair of side plates 332 and a pair of bottom plates 333 that are arranged such that they sandwich the mandrel 5, and accommodates the heating coil 3. The case 33 is shown in an almost rectangular shape. The shape of the case 33 is not restricted to a rectangular shape. It may normally have a shape that is curved along the conveyance direction of the can body 10. This case 33 has a function of preventing the magnetic field from leaking outside and adjusting the magnetic flux.

In the case 33, the distance between to the can body 10 or the heating coil 3, the specific structure or shape of each plate, and the like are appropriately set such that the temperature distribution of the outer surface in the axial direction of the can body 10 to be fitted to the mandrel 5 has a uniform temperature distribution.

(Mandrel)

The mandrel 5 is rotatably attached to a rotating body of a conveyance means of the film label-attaching apparatus. In the mandrel 5, in order to make sure that the can body 10 is mounted and discharged (at the time of discharge) without fail, an air circulation hole for sucking or discharging the can body 10 is formed.

If the can body 10 is a steel can, it is preferred that the mandrel 5 have a ferrite-made ring 51 in adjacent to the lower side of the mounting part of the can body 10. In this embodiment, by arranging the bottom plates 333 in the case 33, the bottom part of the case 33 (bottom plate 333) is allowed to be closer to the ring 51 of the mandrel 5. Due to such a configuration, the magnetic flux of the trim side part 12 of the can body 10 can be adjusted, whereby efficient heating can be conducted.

Further, by the rotation of the mandrel 5 and the rotation of the rotating body, the can body 10 which has been fitted to the mandrel 5 revolves while rotating, and passes through the inside of the case 33 in this state.

Figure 8:
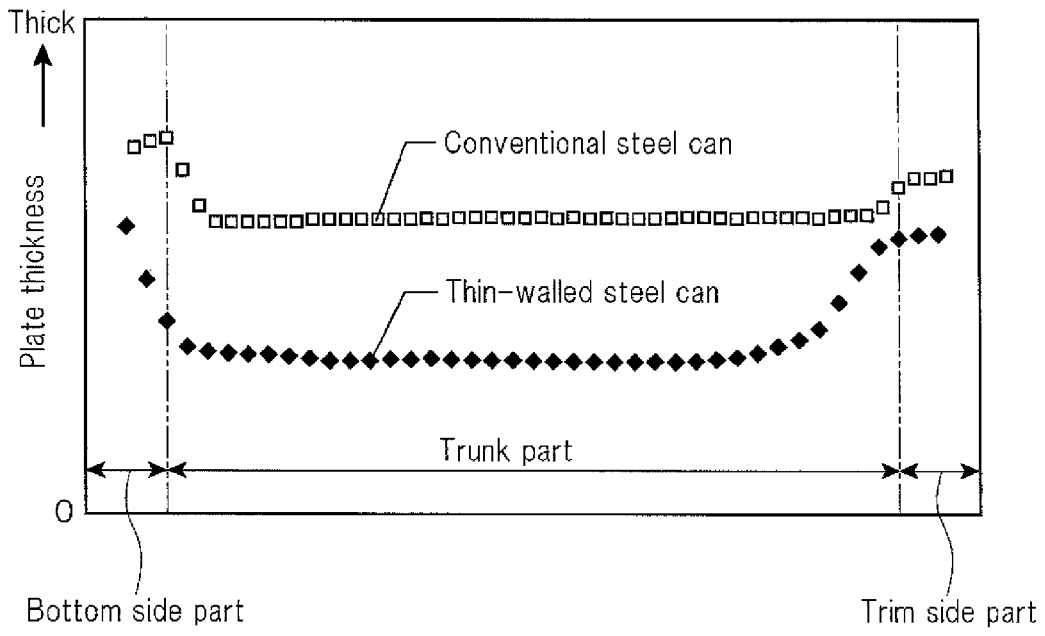
FIG. 8 is a graph for explaining the plate thickness relative to the distance of the bottom of a conventional steel can and a thinned steel can.

Further, as shown in FIG. 8, between the trim side part 12 and trunk part 11, the can body 10 has a large and suddenly changed plate thickness distribution. However, in this embodiment, the unevenness in temperature can be decreased by providing the second coil 32 below the trim side part 12.

As explained in Example 1 and Comparative Example 1 given later, the high-frequency induction heating apparatus 1 had an unevenness in temperature ($=\Delta T$) when heating a thin-walled steel can as the can body 10 of about 29° C. (tolerable unevenness in temperature).

As explained hereinabove, by the high-frequency induction heating apparatus 1, if the plate thickness distribution of the can body 10 as the object to be heated having a small plate thickness is large or changes suddenly, the can body 10 can be uniformly heated (in the state where the unevenness in temperature is tolerable). In addition, the high-frequency induction heating apparatus 1 can preferably be used in the case where the can body 10 is made of aluminum, not steel that has been conventionally used.

This embodiment has various application examples.

The application examples of this embodiment will be explained with reference to the drawings.

<Application Example of the High-Frequency Induction Heating Apparatus>

Figure 3:
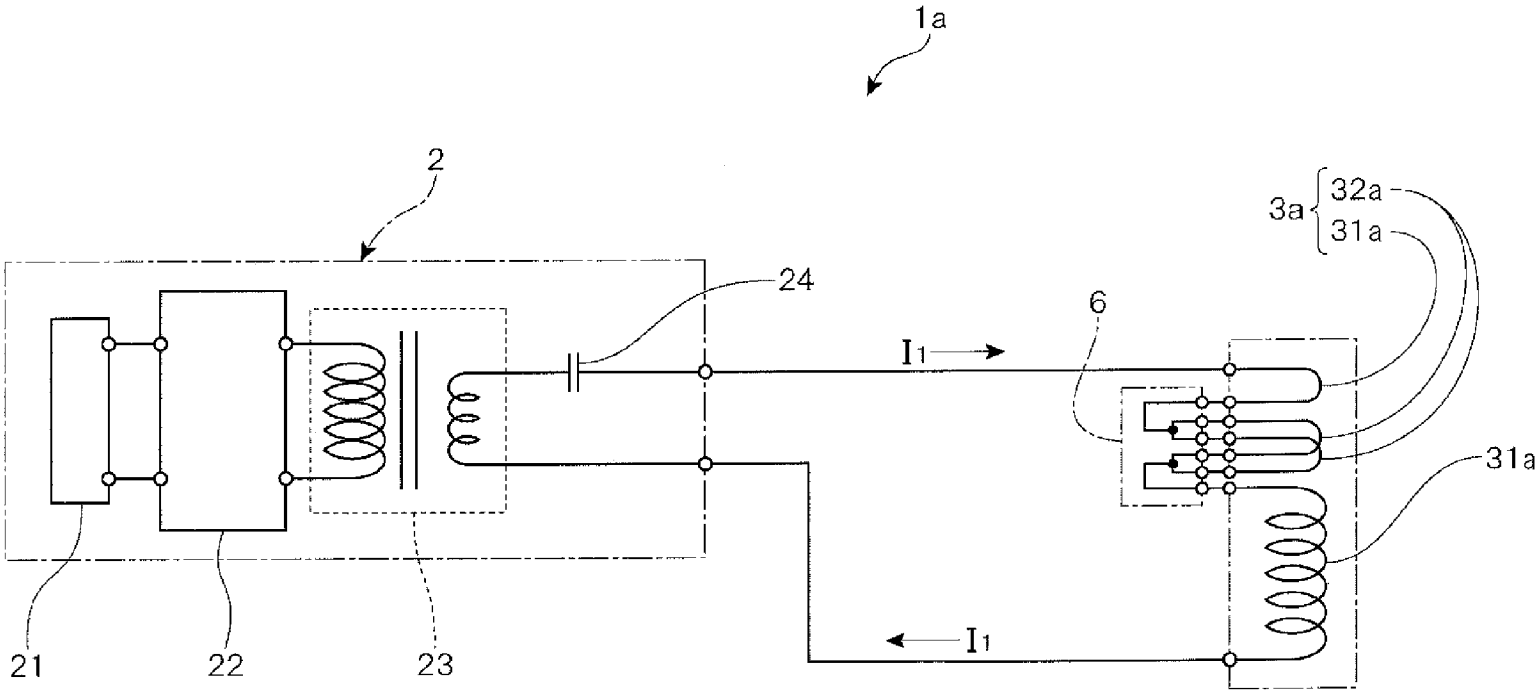
FIG. 3 is a schematic view of essential parts of a high-frequency induction heating apparatus according to an application example of the first embodiment of the present invention.

FIG. 3 is a schematic view of essential parts for explaining the high-frequency induction heating apparatus according to one application example of the first embodiment of the present invention.

Figure 4:
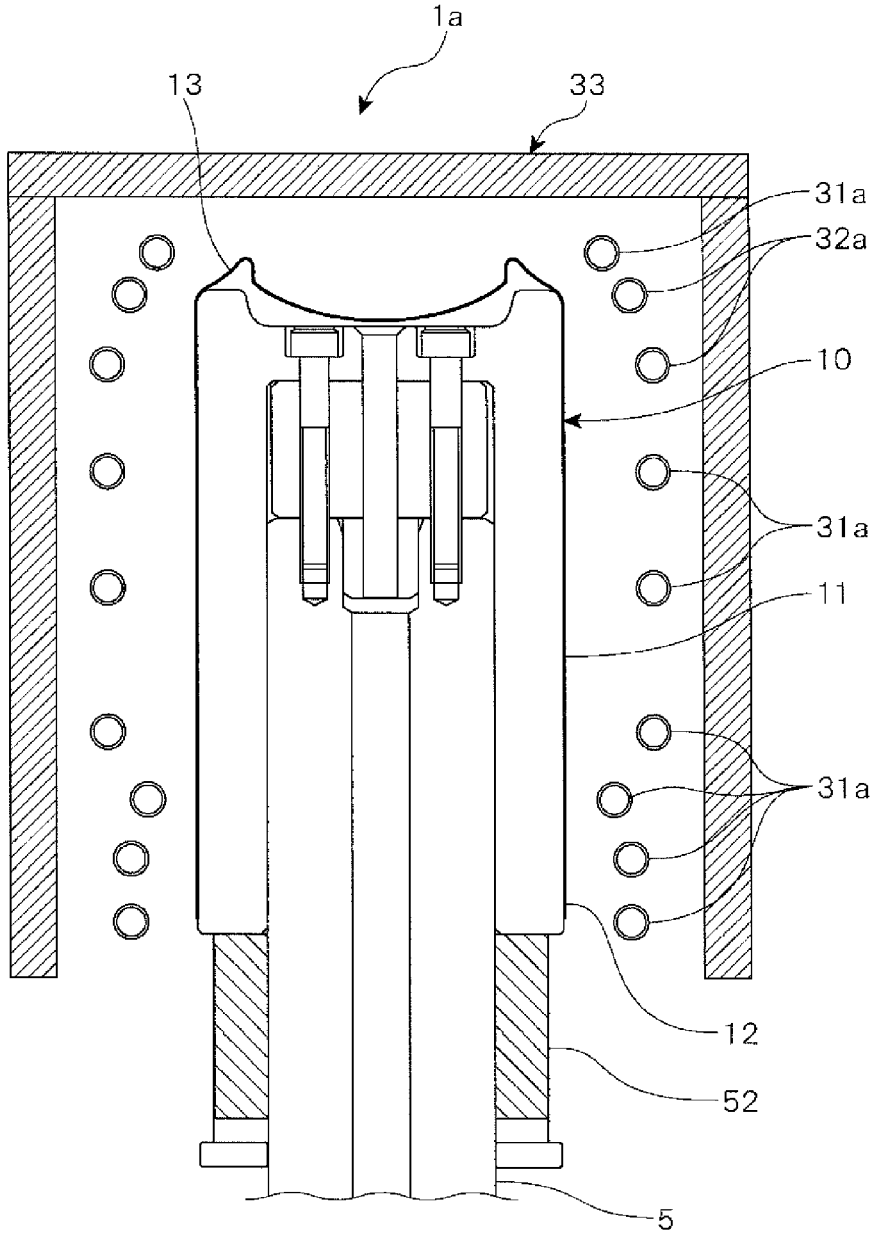
FIG. 4 is a schematic cross-sectional view of essential parts of a high-frequency induction heating apparatus according to an application example of the first embodiment of the present invention.

FIG. 4 is a schematic cross-sectional view of essential parts of a high-frequency induction heating apparatus according to an application example of the first embodiment of the present invention;

In FIGS. 3 and 4, the high-frequency induction heating apparatus 1*a* of the application example differs from the above-mentioned high-frequency induction heating apparatus 1 in that it has a parallel circuit 6 instead of the high-frequency transformer 4 and the like. Other configurations of this application example are almost the same as those of the high-frequency induction apparatus 1.

Therefore, in FIGS. 3 and 4, the same constitutional elements as those in FIGS. 1 and 2 are indicated by the same numerals and a detailed explanation thereof is omitted.

(Heating coil)

A heating coil 3*a* is provided with a first coil 31*a*, a third coil 32*a* and the like. In this application example, the first coil 31*a* has a single turn in the first stages and 6 turns in the 4th to the 9th stages from the top. The first coil 31*a* in the first stage, the primary terminal of the parallel circuit, and the first coil 31*a* in the 4th to the 9th stages are connected in series with the output terminal of the high-frequency oscillation apparatus 2 (see FIG. 3). Through these first coil 31*a*, predetermined AC current ($I_1$) outputted by the high-frequency oscillation apparatus 2 is flown. The first coil 31*a* is arranged such that it inductively heats the first part (in this application example, the upper part of the bottom side part 13, the trunk part 11 and the trim side part 12 of the can body).

In this application example, the third coil 32*a* includes one turn in each of the second and third stages from the top. Each of the third coils 32*a* in the second stage and the third stage is connected to a secondary terminal of the parallel circuit.

Through these third coils 32*a*, AC current ($I_{2a}$($I_{2a}$≈0.5×$I_1$)) different from a prescribed AC current ($I_1$) outputted by the high-frequency oscillation apparatus 2 is flown, and they mainly heat the third part (in this application example, the lower part of the bottom side part 13 and the upper part of the trunk part 11 of the can body 10).

Due to such a configuration, the third coil 32*a* of which the heating performance has been lowered can sufficiently heat the lower part of the bottom side part 13 and the upper part of the trunk part 11 without overheating the trunk part 11 that is close to the bottom side part 13 and has a small plate thickness, whereby heating can be conducted such that the outer surface in the axial direction of the can body 10 has a uniform temperature distribution.

(Parallel Circuit)

In the parallel circuit 6, as mentioned above, the primary terminal is connected in series with the first coil 31*a* relative to the output terminal of the high-frequency oscillation apparatus 2 and each of the third coils 32*a* in the second stage and the third stage is connected in parallel with the secondary terminal. In this application example, the two third coils 32*a* are connected in parallel, but the configuration is not limited thereto. For example, three or more third coils 32*a* may be connected in parallel according to an object to be heated.

As compared with the predetermined AC current ($I_1$) flown through the primary terminal, the AC current ($I_2$, (not shown)) flown through each of the third coils 32*a* in the second and third stages connected to the secondary terminal is decreased with an increase in the number of the third coils 32*a* connected.

The mandrel 5 shown in FIG. 4 is a preferable example for heating an aluminum can as the can body 10. That is, the mandrel 5 in this application example is, as in the case of the above-mentioned embodiment, rotatably attached to the rotating body of the conveyance means of the film label-attaching means. Further, in order to make sure that the can body 10 is mounted and discharged (at the time of discharge) without fail, in the mandrel 5, an air circulation hole is formed for sucking or discharging the can body 10 as in the above-mentioned embodiment.

In addition, as mentioned above, in the steel can, by bringing the ferrite-made ring 51 of the mandrel 5 close to the case bottom part (bottom plate 333), whereby the magnetic flux is concentrated on the trim side part 12, thereby to enable efficient heating (see FIG. 2*b*).

However, when a can body made of aluminum which greatly differs from steel in induction heating efficiency and thermal conductance is heated in the same configuration mentioned above, only the opening end part of the can body is strongly heated and a part of the trim side part in which the thickness is changed is not heated sufficiently.

Therefore, the mandrel 5 shown in FIG. 4 has a cylindrical element 52 formed of a heat-resistant resin such as polyether ketone (PEEK) or a non-magnetic material such as ceramics in adjacent to the down side of the mounting part of the can body 10. Due to the provision of such an element, excessive concentration of the magnetic flux on the opening end part of the can body 10 is prevented.

In the above-mentioned apparatus 1, if an aluminum can is heated, it is preferable to use a mandrel having such a configuration. In this application example, as the mandrel 5 and the ferrite-made case 33, when a steel can is heated as the can body 10, the same as that shown in FIG. 2*b* or FIG. 7 can be used.

In the high-frequency induction heating apparatus 1*a*, as explained in Example 2 and Comparative Example 2 given later, the temperature unevenness (=LST) when an aluminum can is heated as the can body 10 was about 30° C. (tolerable unevenness).

As explained hereinabove, according to the high-frequency induction heating apparatus 1*a*, when the plate thickness distribution of the can body 10 as the object to be heated is large or changes suddenly, and the material thereof is aluminum, it is possible to heat the can body 10 uniformly (in the state where the unevenness in temperature is tolerable).

In the configuration of this application example, the heating coil 3*a* is provided with the first coil 31*a* and the third coil 32*a*. The configuration is not limited thereto. For example, although not shown, it may have a configuration in which the heating coil has a first coil through which predetermined current outputted by the high-frequency oscillation apparatus 2 is flown, a second coil through which current different from the predetermined current is flown by the high-frequency transformer 4 and a third coil through which current different from the predetermined current is flown by the parallel circuit 6, and the first coil heats the first part of the object to be heated, the second coil heats the second part of the object to be heated and the third coil heats the third part of the object to be heated. The number of the high-frequency transformer 4 or the parallel circuit 6 is not limited to one, and the number of them may respectively be two or more.

[First Embodiment of the Film Label-Attaching Apparatus]

The present invention is effective as an invention of the film label-attaching apparatus. Though not shown, the film label-attaching apparatus of this embodiment has a plurality of rotatable mandrels 5, and is provided with a conveyance means that conveys the can body 10 fitted to the mandrel 5, the heating means that inductively heats the can body 10 fitted to the mandrel 5 (the high-frequency induction heating apparatus 1 mentioned above) and an attaching means that attaches a film label to the can body 10 being conveyed in the downstream of this heating means.

The film label-attaching apparatus of this embodiment has almost the same configuration as the film label-attaching apparatus of the above-mentioned Patent Document 1.

The heating means not limited to the high-frequency induction heating apparatus 1, and it may be the high-frequency induction heating apparatus 1*a* or a high-frequency heating apparatus 1*b*, mentioned later.

In the film label-attaching apparatus of this embodiment, the high-frequency induction heating apparatus 1 can heat the can body 10 uniformly (in the state where the temperature unevenness is tolerable) even in the case where the plate thickness distribution of the thinned can body 10 is large or changes suddenly, as mentioned above. As a result, the film label-attaching apparatus effectively prevents disadvantages that adhesion strength of a film label varies, a film label peels off in the post treatment or a film label wrinkles at the time of neck-in processing.

Subsequently, Examples, Comparative Examples and the like of the high-frequency induction heating apparatus will be explained.

[Example 1 of the High-Frequency Induction Heating Apparatus]

The high-frequency induction heating apparatus of Example 1 has almost the same configuration as the above-mentioned high-frequency induction apparatus 1 (see FIGS. 1 and 2) and heated the can body 10 inductively.

The can body 10 is a steel can having a small plate thickness. As shown in FIG. 8, it had a plate thickness (=Tf) on the trim side part 12 of about 0.17 mm, and a plate thickness (=Tw) on the central part of the trunk part 11 of about 0.09 mm. The plate thickness ratio (=Tf/Tw) was about 1.83. A black color spray was blown to this can body 10 so that the temperature of each part can be measured by a thermo-vision. The can body 10 was installed in (fitted to) the mandrel 5 that was positioned almost middle of the case 33.

In the high-frequency heating apparatus 1, the rated power of the high-frequency oscillation apparatus 2 was about 35 kW. In the state where it was positioned almost middle of the case 33, the can body 10 that was rotated at a speed of 540 rpm was inductively heated for 1 second.

The position of the heating coil 3 and the like are as almost same as those shown in FIG. 2*b*. Of the 7-turn heating coils 3, a single turn in the lowest stage, i.e. closest the trim side part 12, was taken as the second coil 32 and the remaining turns were taken as the first coils 31.

When the temperature of the can body 10 was measured by means of a thermo-vision immediately after the high-frequency induction heating apparatus 1 inductively heated the can body 10 for 1 second, the highest temperature was observed in a part of the trim side part 12 where the plate thickness changes, and the lowest temperature was observed at the end part of the opening. The unevenness in temperature (=ΔT) was about 29° C. (almost tolerable) (see FIG. 5).

The current $I_1$ that was flown through the first coil 31 was about 88 A, and the current $I_2$ that was flown through the second coil 32 was about 220 A.

[Comparative Example 1 of the High-Frequency Induction Heating Apparatus]

Figure 7:
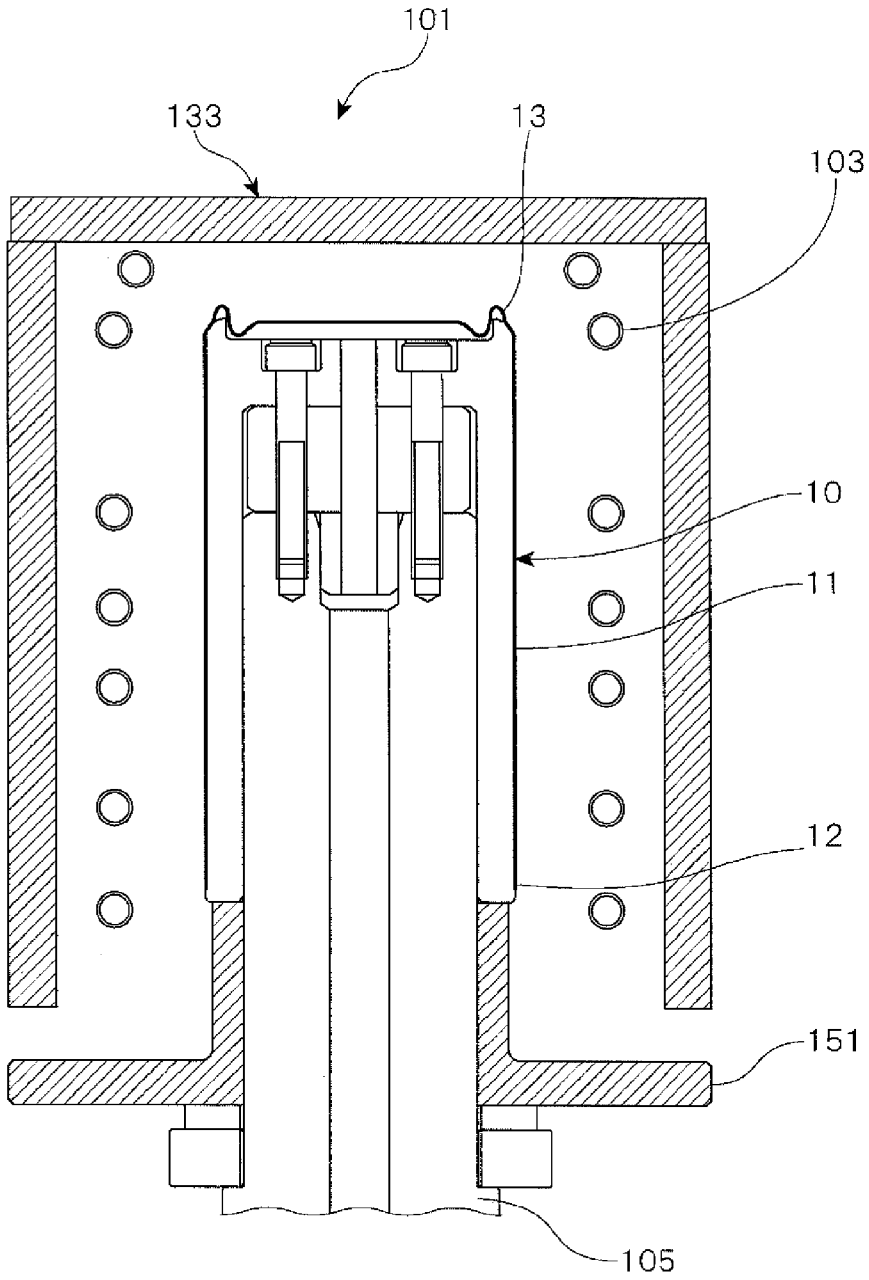
FIG. 7 is a schematic view of essential parts for explaining a high-frequency induction heating apparatus according to a conventional example.

As Comparative Example 1, the can body 10 (a steel can having a small plate thickness) was inductively heated by means of the high-frequency induction heating apparatus 101 shown in FIG. 7. This high-frequency induction heating apparatus 101 has almost the same configuration as that of the high-frequency induction heating apparatus 1 of Example 1, except that the heating coil 103 is formed of a single coil.

Figure 5:
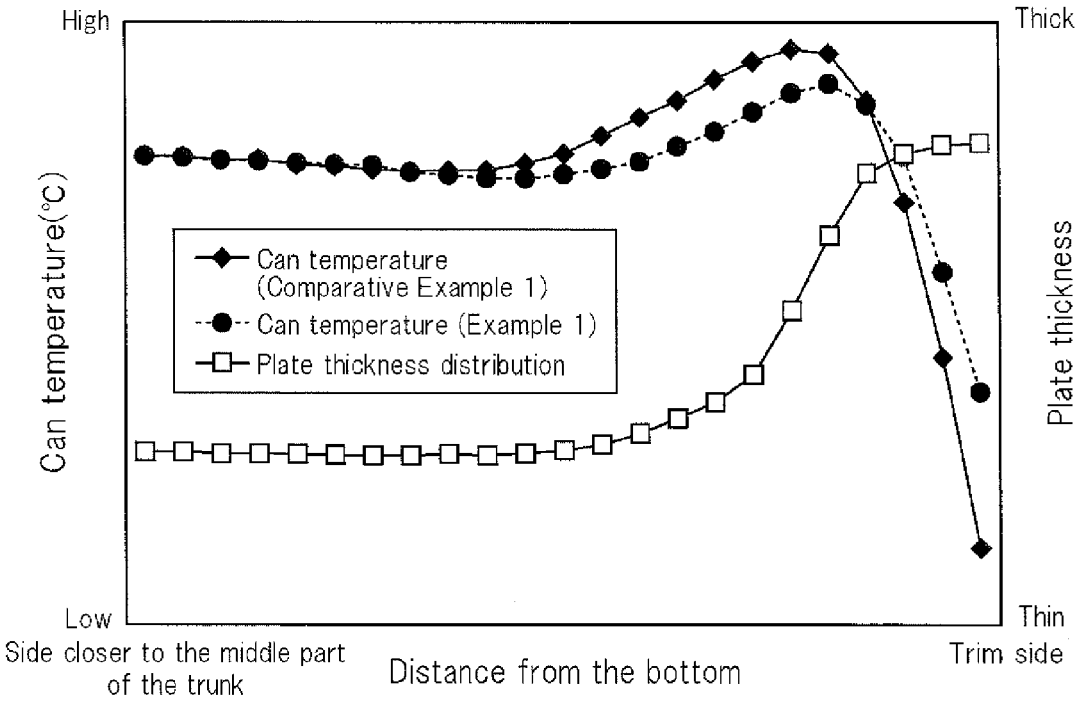
FIG. 5 is a graph for explaining the can temperature relative to the distance from the bottom in Example 1 and Comparative Example 1.

When the temperature of the can body 10 was measured by means of a thermo-vision immediately after the high-frequency induction heating apparatus 101 inductively heated the can body 10 for 1 second, the unevenness in temperature (=ΔT) was about 50° C. (intolerable) as shown in FIG. 5.

That is, in order to decrease the unevenness in temperature, the distance between the heating coil 103 and the can body, the pitch in the axial direction of the can, the positional relationship of the case 133 or the like were varied. However, by these conventional adjustment methods, the unevenness in temperature could not be corrected.

[Example 2 of the High-Frequency Induction Heating Apparatus]

The high-frequency induction apparatus of Example 2 had almost the same configuration as that of the above-mentioned high-frequency induction apparatus 1*a* (see FIGS. 3 and 4), and the can body 10 was inductively heated by this apparatus.

The can body 10 was an aluminum can, and as mentioned above, the plate thickness of each of the trim side part 12 and the bottom side part 13 had a larger distribution than that of the plate thickness of the trunk part 11. The plate thickness (=Tf) of the trim part side 12 was about 0.17 mm and the plate thickness (=Tw) of the middle part of the trunk part 11 was about 0.12 mm, and the plate thickness ratio (=Tf/Tw) was about 1.47.

In the high-frequency induction heating apparatus 1*a*, the heating coil 3*a* is almost as that shown in FIG. 4. Of the 9-turn heating coils 3*a*, a turn in the highest stage was taken as the first coil 31*a*, two turns in the second and third highest stages were taken as the third coils 32*a*, and the remaining turns were taken as the first coil 31*a*. The other configurations were the same as those in the high-frequency induction apparatus 1 of Example 1. Induction heating was conducted for 1 second for the can body 10 that was rotated at 540 rpm.

When the temperature of the can body 10 was measured by means of a thermo-vision immediately after the high-frequency induction heating apparatus 1*a* inductively heated the can body 10 for 1 second, the highest temperature was observed in a part having a small plate thickness which is closer to the trim side part from the central part of the trunk part, and the lowest temperature was observed in a part of the trim side part having a large plate thickness. The unevenness in temperature (=ΔT) was about 30° C. (almost tolerable).

[Comparative Example 2 of High-Frequency Induction Heating Apparatus]

By using the conventional high-frequency induction heating apparatus 101, the aluminum-made can body 10 was inductively heated in the same manner as in Example 2, except that the mandrel having a cylindrical element as shown in FIG. 4 was used.

When the temperature of the can body 10 was measured by means of a thermo-vision immediately after the high-frequency induction heating apparatus 101 inductively heated the can body 10 for 1 second, the highest temperature was observed in the trunk part closer to the bottom side part and the lowest temperature was observed in a part having a large plate thickness of the trim side part, and the unevenness in temperature (=ΔT) was about 60° C. (intolerable). The distance between the heating coil 103 and the can body, the coil pitch in the axial direction of the can, the positional relationship of the case 133 or the like were adjusted, but the unevenness in temperature could not be corrected.

As explained hereinabove, from each Example and Comparative Example, in the case of the high-frequency induction heating apparatus 1, in the high-frequency induction heating apparatus 1*a* or the like, if the plate thickness ratio of the can body (=Tf/Tw) is 1.2 or more, preferably 1.4 or more, and further preferably 1.8 or more, or the material of the can body is different from conventional materials, the can body could be inductively heated uniformly (in the state where unevenness in temperature is tolerable).

[Second Embodiment of the High-Frequency Induction Heating Apparatus]

Figure 6:
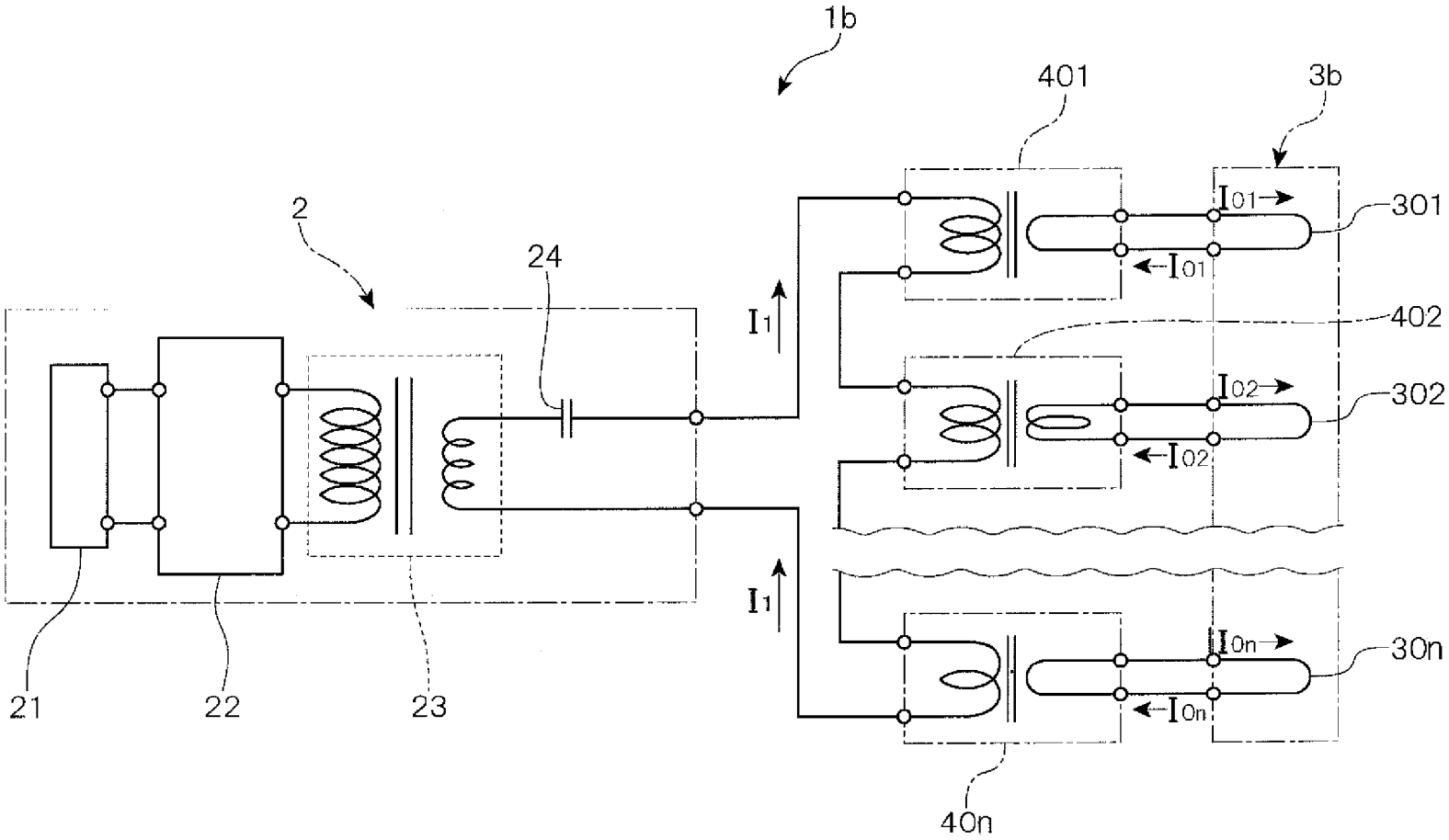
FIG. 6 is a schematic view of essential parts of a high-frequency induction heating apparatus according to a second embodiment of the present invention.

FIG. 6 is a schematic view of essential parts of a high-frequency induction heating apparatus according to a second embodiment of the present invention. In FIG. 6, the high-frequency induction heating apparatus 1*b* of this embodiment is provided with the high-frequency oscillator 2, high frequency current transformers 401, 402, . . . 40*n* which are connected in series with this high-frequency induction apparatus, a plurality of second coils 301, 302, . . . 30*n* and the like, through which current from the plurality of high-frequency transformers 401, 402, . . . 40*n* is flown. The plurality of second coils 301, 302, . . . 30*n* are integrally constitute the heating coil 3*b*, whereby a part of the can body as an object to be heated (not shown) is respectively heated.

In FIG. 6, the same constitution elements as those in FIG. 1 are indicated by the same numerals and a detailed explanation is omitted.

(High-Frequency Transformer)

Each of the plurality of the high-frequency transformers 401, 402, . . . 40*n* is the same as that in the high-frequency transformer 4 in the above-mentioned embodiment, and each primary side is connected in series with the high-frequency oscillator 2. Further, the ratio of current transformation K of each of the high-frequency transformers 401, 402, . . . 40*n* is appropriately set according to the object to be heated. The quantity or the like of the plurality of high-frequency transformers 401, 402, . . . 40*n* are not particularly restricted.

(Heating Coil)

The entire configuration of the heating coil 3*b* having a plurality of second coils 301, 302, . . . 30*n* is almost the same as that in the above-mentioned embodiment.

In this embodiment, the second coil 301 is a single turn, and is connected to the secondary side of the high-frequency transformer 401. Through this secondary coil 301, AC current ($I_{Q1}$) according to the ratio of current transformation K is flown, a predetermined part of the can body is inductively heated.

The AC current ($I_{01}$) is normally different from the predetermined current ($I_1$) outputted by the high-frequency oscillation, but not limited thereto. $I_{01}$ may be the same as $I_1$, for example.

Further, the second coil 301 is a single turn, but the number of turns is not limited thereto. The second coil may be two or more turns, for example.

The second coil 302, . . . 30*n* have almost the same configuration as that of the second coil 301.

As for the second coils 301, 302, . . . 30*n*, the heating performance is appropriately set according to the high-frequency transformers 401, 402, . . . 40*n*. Therefore, instead of adjusting the distance between the coil and the can body, the pitch of the coils and the like, by appropriately setting the ratio of current transformation K, it is possible to heat such that the outer surface of the axial direction of the can body has a uniform temperature distribution. In this case, as compared with adjusting the distance between the heating coil 3*b* accommodated in the case 33 and the can body, the pitches of the coils and the like, adjusting the ratio of current transformation K of the high-frequency transformers 401, 402, . . . 40*n* accommodated outside the case 33 is easier, and hence, productivity and the like can be improved.

As for the second coils 301, 302, . . . 30*n*, the distance to the can body, the coil pitch and the like may be set.

Further, when the model of the can body is changed, in the high-frequency induction heating apparatus 1, for example, the heating coil 3 and the case 33 provided in the film label-attaching apparatus are required to be changed. In the case of the high-frequency induction heating apparatus 1*b*, by appropriately setting the ratio of current transformation K of the high-frequency transformers 401, 402, . . . 40*n*, it is possible to heat such that the outer surface of the axial direction of the can body has a uniform temperature distribution.

As explained hereinabove, in the case of the high-frequency heating apparatus 1*b*, since the heating performance of the second coils 301, 302, . . . 30*n* is set appropriately by the high-frequency transformers 401, 402, . . . 40*n*, even when the plate thickness distribution of an object to be heated is large or changes suddenly, or the material of the can body is different, as almost the same in the first embodiment, induction heating can be conducted such that the outer surface of the axial direction of the can body has a uniform temperature distribution.

Hereinbefore, the high-frequency induction heating apparatus and the film label-attaching apparatus of the present invention are explained with reference to preferable embodiments. The high-frequency induction heating apparatus and the film label-attaching apparatus of the present invention are not limited to the above-mentioned embodiments or the like, and it is needless to say various modifications are possible within the scope of the present invention.

For example, the above-mentioned high-frequency induction heating apparatus 1 and the like is used in the film label-attaching apparatus. However, the application of the high-frequency induction heating apparatus is not limited thereto.

For example, the mentioned high-frequency induction heating apparatus may be applied to heat-treatment for easing distortion of the can body which arises at the time of the molding operation. Further, the mentioned high-frequency induction heating apparatus may be applied not only when obtaining uniform temperature distribution, but when obtaining predetermined temperature distribution. Furthermore, the present invention is applied not only to a case where the can body is directly heated, but also to a case where a heat-conductive medium (an outer sheath of the mandrel disclosed in Patent Document 2, for example) is heated by the high-frequency induction heating apparatus, and the can body is in-directly heated through this medium. When a heat-conductive medium is used, the object to be heated is not limited to a metal product such as a can body, but also a plastic product can be heated. That is, in JP-B-05-071028 for example, as a method for heating a preform of a thermoplastic bottle to be subjected to blow molding, a method is disclosed in which a metal bar (a heat conductive medium) is inserted into a bottomed cylindrical preform, and heating is conducted from the inside. The present invention can be applied to a case where this metal bar is heated.

The high-frequency induction heating apparatus and the film label-attaching apparatus of the present invention are effective as inventions of a high-frequency induction heating method and a film label-attaching method.

The invention claimed is:

1. A high-frequency induction heating apparatus comprising:

a high-frequency oscillation apparatus;

a heating coil;

a mandrel that rotates a can body; and a ferrite-made case, wherein the can body is a steel can and moves while being rotated by the mandrel, the heating coil comprises a first coil heating a first part of the can body, wherein predetermined current outputted by the high-frequency oscillation apparatus flows through the first coil, the ferrite-made case accommodates the heating coil and surrounds a moving path of the mandrel, and the mandrel comprises a ferrite-made ring that is adjacent to a mounting part of the can body and close to a bottom part of the case, wherein the heating coil further comprises a second coil heating a second part of the can body, wherein current different from the predetermined current flows through the second coil by a high-frequency current transformer, and/or a third coil heating a third part of the can body, wherein current different from the predetermined current flows through the third coil by a parallel circuit.

2. A high-frequency induction heating apparatus comprising:

a high-frequency oscillation apparatus;

a heating coil;

a mandrel that rotates a can body; and a ferrite-made case, wherein the can body is an aluminum-made can and moves while being rotated by the mandrel, the heating coil comprises a first coil heating a first part of the can body, wherein predetermined current outputted by the high-frequency oscillation apparatus flows through the first coil, the ferrite-made case accommodates the heating coil and surrounds a moving path of the mandrel, and the mandrel comprises a non-magnetic cylindrical element adjacent to a mounting part of the can body, wherein the heating coil further comprises a second coil heating a second part of the can body, wherein current different from the predetermined current flows through the second coil by a high-frequency current transformer, and/or a third coil heating a third part of the can body, wherein current different from the predetermined current flows through the third coil by a parallel circuit.

* * * * *